United States Patent [19]

Landis

[11] 3,947,218

[45] Mar. 30, 1976

[54] SAFETY CIRCUIT FOR MONITORING A FLICKERING FLAME

[75] Inventor: William R. Landis, Richfield, Minn.

[73] Assignee: Honeywell Inc., Minneapolis, Minn.

[22] Filed: Jan. 23, 1975

[21] Appl. No.: 543,565

[52] U.S. Cl. ..... 431/79; 340/228.2

[51] Int. Cl.[2] ..... F23N 5/08

[58] Field of Search ..... 431/79; 340/228.2; 307/117

[56] References Cited

UNITED STATES PATENTS

| | | | |
|---|---|---|---|
| 3,651,327 | 3/1972 | Thomson | 431/79 X |
| 3,742,474 | 6/1973 | Muller | 340/228.2 |
| 3,852,729 | 12/1974 | Cade | 431/79 X |

*Primary Examiner*—Edward G. Favors

*Attorney, Agent, or Firm*—Alfred N. Feldman

[57] ABSTRACT

An electronic network for safe operation of an infrared flame flicker burner control system is disclosed. The network is placed across the infrared flame detector and modifies the detector's action in the event of a flameout so that a refractory shimmer effect is reduced to avoid falsely causing the burner control system to indicate the presence of flame.

7 Claims, 5 Drawing Figures

SAFETY CIRCUIT FOR MONITORING A FLICKERING FLAME

BACKGROUND OF THE INVENTION

In fuel burner control systems that operate by monitoring the infrared radiation of a flickering flame, problems have arisen where the system is fooled by the infrared radiation of the hot refractory material in the furnace and a shimmering effect caused by the movement of air currents or unburnt fuel. The movement of unburnt fuel and/or air causes a shimmer or flickering to appear at the flame detector which simulates the presence of a flame and the system can thus fail in an unsafe manner.

SUMMARY OF THE INVENTION

The present invention recognizes the possibility of an unsafe set of circumstances occuring in a sudden loss of flame in a system monitored by an infrared flame flicker type system. An extensive investigation into the output voltage of an infrared photocell versus time during the start, pilot flame, main burner operation, and a flameout has disclosed that when a flameout occurs the infrared photocell voltage rises very sharply but can have the characteristics of a flickering caused by the combination of a hot refractory and the rising of air and/or unburnt fuel. Prior art devices have been used wherein a diode, resistor, and capacitor network is connected across the infrared photocell so that the capacitor will slowly discharge during normal operations and rapidly charge during a flameout to filter infrared flicker for a short time interval so that safe operation of the system can be accomplished. The prior art arrangements did not recognize the existence of various types of external interference such as radio frequency signals generated by other electrical equipment, ignition equipment, and local radio stations. This additional interference has caused the prior art safety networks to be less effective than desired. The present invention utilizes a unique combination of a particular type of diode, an additional resistor, and a radio frequency bypass capacitor in order to correct the shortcomings of the prior art devices.

DESCRIPTION OF THE PREFERRED EMBODIMENT

Figure 1:
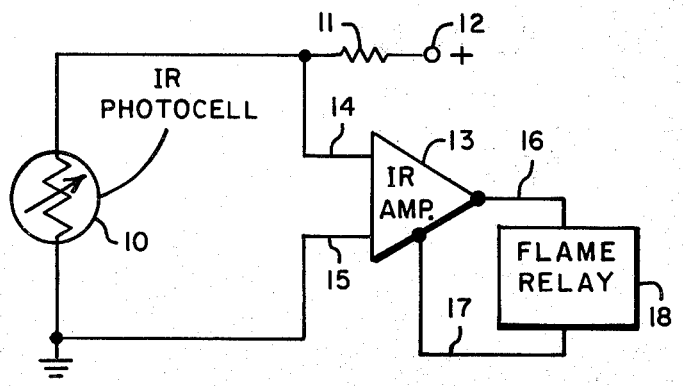
FIG. 1 (PRIOR ART)
FIG. 1 is a schematic representation of a simple infrared photocell controlled flame flicker type system.

FIG. 1 discloses a prior art configuration of a very simple fuel burner control system utilizing an infrared photocell and a flame flicker amplifier. An infrared photocell 10 is disclosed and has a normally high resistance in the absence of flame or an infrared radiation. In the presence of a flame, the infrared radiation drives the resistance of the photocell to a relatively low value.

The photocell 10 forms part of a voltage divider with resistor 11 from a voltage source 12. A flame flicker type of amplifier means 13 is generally disclosed and can also be energized from the same source of energy as the terminal 12. The infrared flame flicker amplifier 13 is a conventional type of flame flicker amplifier that responds to variations in voltage across conductors 14 and 15, which are in turn connected across the photocell 10. The variations in voltage result as a variation in the resistance of photocell 10 as part of the previously described voltage divider network. A conventional burner, such as a gas burner or an oil burner, has a flame that has a distinct flicker with an amplitude that varies with the reciprocal of frequency ($1/f$). The infrared flame flicker amplifier 13 has a response that is particularly tuned to the flame flicker frequency and in a conventional case would be a band-pass type of amplifier commercially used for many years. The band-pass range would be in the flame flicker frequency range of 2 to 40 hertz and would be cut off quite sharply below the 60 cycle per second or 60 hertz frequency range normally used to energize such systems. This is a safety precaution to prevent 60 hertz interference from passing through the amplifier 13 and simulating a flame.

The output of the infrared amplifier 13 is by way of a pair of conductors 16 and 17 to operate a flame relay 18. The flame relay 18 is part of a burner control system and in turn energizes some type of fuel supply means in a conventional fashion.

Figure 2:
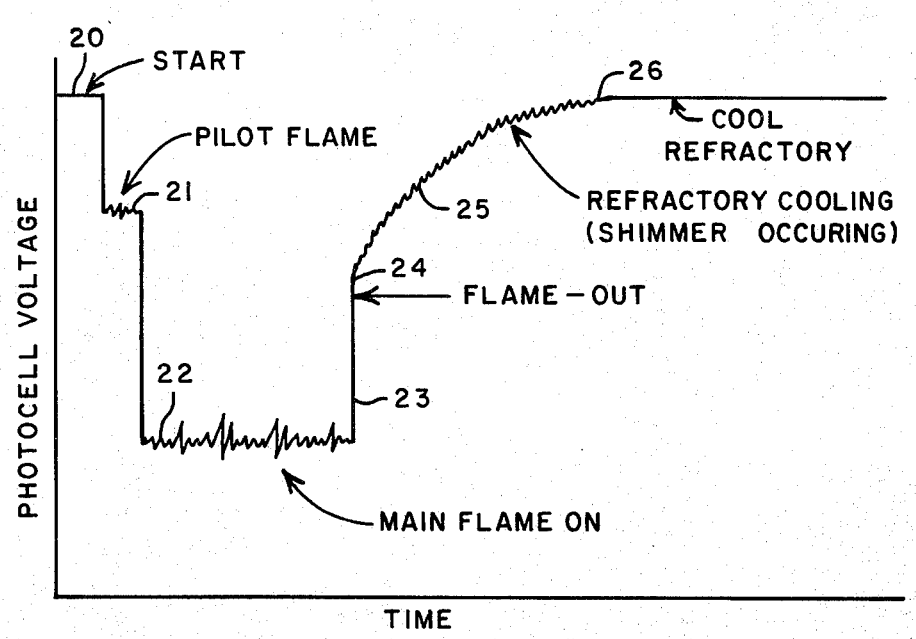
FIG. 2 is a voltage and time graph of a system such as disclosed in FIG. 1 showing the voltage across the infrared photocell versus time.

It has been found that when the type of system disclosed in FIG. 1 is used, it has a voltage versus time curve similar to that disclosed in FIG. 2. The voltage across the photocell 10 is a relatively high value at the start time 20, and then drops abruptly to 21 when the pilot flame in the burner is ignited. As soon as the main burner ignites, a further flame appears and the voltage across the photocell 10 drops to the voltage shown at 22. The voltage at 22 is not uniform but varies with the flame intensity and flame flicker, and has been disclosed as an irregular voltage in a relatively limited voltage range.

At a time 23 when the flame is either intentionally turned "off" or is accidently extinguished, the photocell 10 voltage rises very abruptly to 24 and than more slowly rises at 25 with a flickering or shimmering effect as the photocell 10 senses the hot refractory surface of the burner. As time passes, the photocell voltage becomes relatively fixed at 26 with what is referred to as a cool refractory surface.

The type of system disclosed in FIGS. 1 and 2 is very functional in a theoretical sense, but in a practical application, problems have arisen that make the system unsafe. During the refractory cooling portion 25 of the curve, variations in the voltage of the photocell 10 can simulate flame by the unburnt fuel, air currents, and similar products of combustion that move through a hot burner. In the event of a flameout, the movement of fuel along with the air and the hot refractory can simulate flame and create an exceedingly unsafe condition. The simulated flame of the refractory shimmer 25 could create an explosive condition by the introduction of unburnt fuel to a hot burner area and the fuel could accidently be ignited with an explosive impact.

Figure 3:
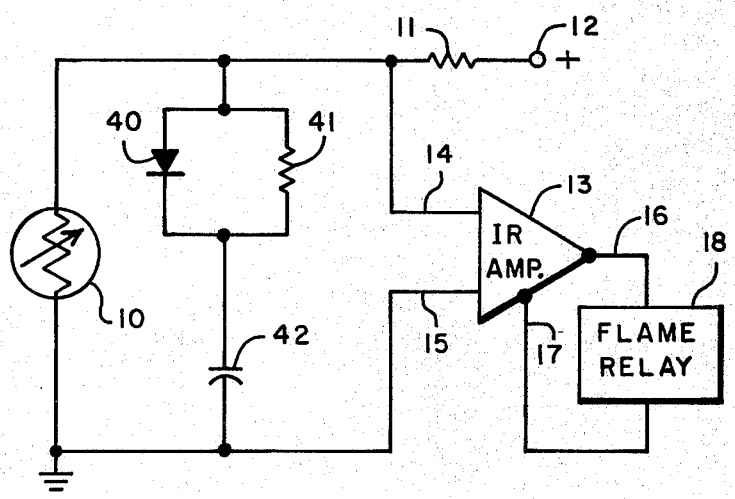
FIG. 3 (PRIOR ART)
FIG. 3 is a system similar to FIG. 1, but with the prior art safety network of a diode, resistor, and a capacitor added.

In FIG. 3, a first step in correcting the refractory holdin problem was taken and has been disclosed as prior art to the present invention. Once again the photocell 10 is provided with the voltage dropping resistor 11 to a voltage source 12, along with conductors 14 and 15 to an infrared flame flicker amplifier means 13. Output conductors 16 and 17 control a flame relay 18. The system disclosed in FIG. 3 has been modified by the additional of a parallel combination of a diode 40 and a relatively high resistor 41, which parallel combination is in series with a capacitor 42. The network made up of the diode 40, resistor 41, and the capacitor 42 theoretically provide a system which reduces response to a hot refractory holdin type of problem. When the system is energizes, the capacitor 42 charges through the diode 40 to a relatively high voltage. The voltage on capacitor 42 rises to approximately the same level as the voltage across the photocell 10 before the system is put into operation. When the burner is ignited, the photocell voltage drops to a level corresponding to the voltage 22 of FIG. 2. The capacitor 42 now discharges slowly into the amplifier 13 and the photocell 10 through the relatively high resistor 41. The resistor 41 is a large resistor to insure that the capacitor 42 does not degrade the flame flicker signal. Eventually, the voltage across the capacitor 42 will approximate the averate voltage of the photocell 10. The capacitor 42 and the diode 40 now act as an adjustable voltage clipper. The voltage across capacitor 42 charges through the diode 40 whenever the voltage across photocell 10 exceeds the voltage on the capacitor 42 plus the drop across the diode 40.

Figure 4:
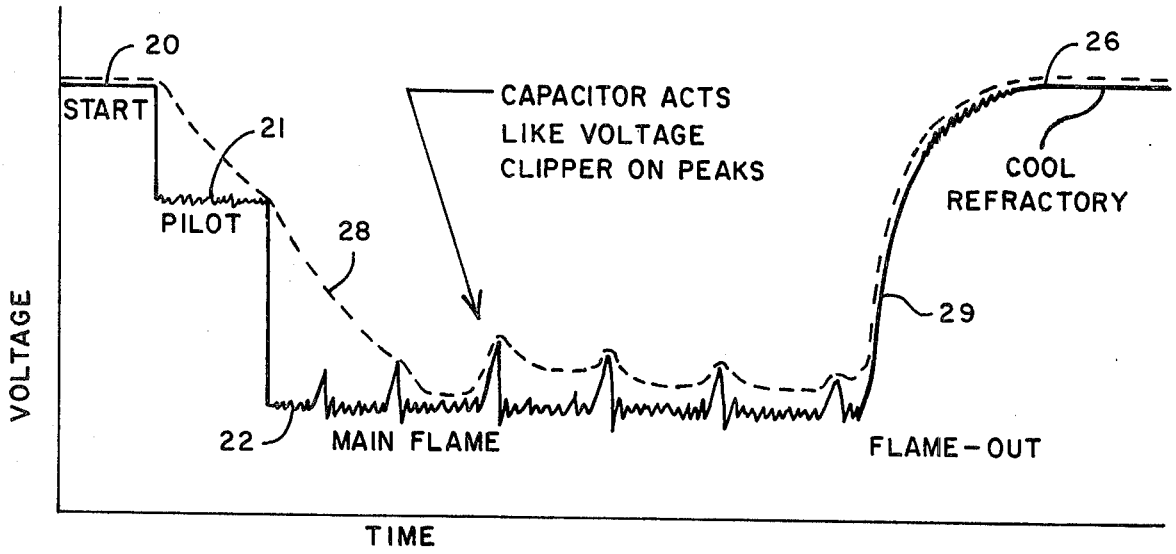
FIG. 4 is a voltage versus time graph of a system utilizing a safety network of FIG. 3.

As shown in FIG. 4, by a dashed line 28, the capacitor voltage follows the voltage across the photocell 10 down as the pilot and than main flame are ignited. The capacitor 42 acts like a voltage clipper on the peaks and basically follows an average type of response during the time when the main flame is burning. In FIG. 4, the capacitor 42 is effectively "switched" into the circuit whenever it charges. Whenever the capacitor 42 discharges it is effectively "switched" out of the circuitry by the resistor 41 and the diode 40. The photocell 10 has voltage peaks that are sufficient in amplitude and frequency to keep the capacitor 42 "switched" out of the circuit most of the time. This is why the modification has little effect on the flame sensitivity during a normal burner operating cycle. When a flameout occurs, the photocell 10 has a voltage which abruptly rises at 29 of FIG. 4 to a new average value determined by temperature of the combustion chamber walls as viewed by the photocell 10. The capacitor 42 is now considered "switched" into the circuit through the diode 40 and any flame flicker signal will be filtered by the capacitor 42. The effectiveness of this filtering is determined by the series impedance of the capacitor 42 and the diode 40 in combination. This impedance varies with the current through the diode 40. The diode 40 current varies with the voltage difference between capacitor 42 and the photocell 10. While capacitor 42 charges, represented by voltage 29 of FIG. 4, any flame flicker will be filtered and the control acts as if the burner has lost its flame and thereby allows the flame relay 18 of FIG. 3 to drop out turning "off" the burner in a proper manner. Once again, in theory, the system of FIGS. 3 and 4 would eliminate the infrared refractory holdin problem that has developed in actual burner installations. The system is quite effective in eliminating false flame indications from a shimmer caused by moving air currents or unburnt fuel between the photocell and the refractory walls. Unfortunately, a further type of interference was found to cause this type of system to still fail in an unsafe manner in many installations.

Figure 5:
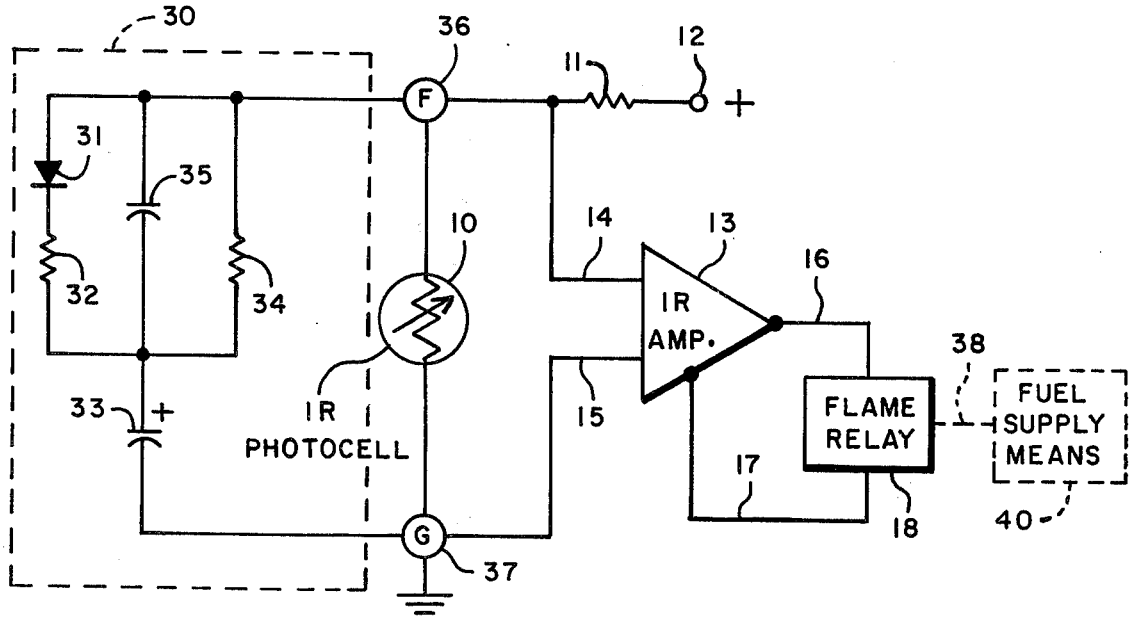
FIG. 5 is a schematic representation of the improvement forming the present invention.

The improvement which overcomes these failures is disclosed in FIG. 5 and forms the basis of the present invention. Installations utilizing the circuit of FIG. 3 and having a voltage versus time curve similar to FIG. 4 have falsely indicated the presence of flame in certain types of installations. It was found that this type of installation had picked up radio frequency interference from various sources such as ignition devices, other electrical equipment in the immediate vicinity, and even radio signals from local radio stations. The radio frequency signals would be picked up and rectified through the diode 40 of FIG. 3 to charge the capacitor 42 during times when the capacitor should not be charged thereby creating system failures. The addition of components to the network across the photocell, as disclosed in FIG. 5, have eliminated this problem. The system disclosed in FIG. 5 includes a safety network means 30 which includes a special diode 31, a series impedance 32, and a first capacitor 33. A second capacitor 35 and a resistor 34 are connected in parallel and in turn are connected across the series combination of the diode 31 and the impedance 32. The impedance 32 has been shown in its simplest form as a resistor. The safety network means 30 is unique in that it provides for the rejection of false flame flicker signals caused by a refractory holdin problem, and also acts as a radio frequency rejection or compensation network.

The diode 31 requires an unusual characteristic in that it should be a diode which has a very low forward voltage drop and a very high resistance to reverse leakage. As a result of this, the diode 31 is a Schottkey barrier diode. In order to make the network insensitive to radio frequency signals which would be rectified by the high-quality diode 31, the impedance 32 has been added in series with the diode 31. The impedance or resistor 32 is approximately 2,000 ohms and is related to the resistance of photocell 10. Its resistance is low enough to provide a good response to the normal flameout signals, but is high enough in impedance to provide the rejection of radio frequency signals that would be rectified by the diode 31. The capacitor 33 is of the same magnitude as disclosed in the prior art device of FIG. 3, while the capacitor 35 is a radio frequency bypass capacitor to aid in the removal of any radio frequency signals from the system. Its capacitance must be kept low in order to avoid degrading the flame flicker sensitivity of the burner control system. The resistor 34 is similar to the resistor 41 of FIG. 3.

The safety network means 30 is connected across the flame and ground terminals 36 and 37 of the photocell 10, which is again connected by conductors 14 and 15 to a flame flicker type of amplifier 13. The photocell 10 is also connected by the resistor 11 to a voltage terminal 12, which supplies the voltage for the infrared flame flicker amplifier 13. The output conductors 16 and 17 from the amplifier 13 provide the energization of the flame relay 18. The flame relay 18 is connected by conductors 38 to a fuel supply means 40 to complete a fuel flow control means used in a conventional fuel burner.

Actual field experience with the safety network means 30 has proven it to be effective against both radio frequency interference and false infrared flicker signals generated by the shimmer effect of fumes moving in a hot burner between the photocell 10 and the refractory surface of the burner. It is also been found that the components made up of diode 31, resistor 32, capacitor 33, the capacitor 35, and the resistor 34 require mounting in close proximity to one another to cut down the pickup on the leads between the components so that radio frequency interference can be properly rejected.

At the time the prior art device disclosed in FIGS. 3 and 4 was produced, it was not obvious to the electronics engineers working on this problem that a radio frequency pickup problem would defeat the prior art safety networks. This was found only after considerable experimentation in the field. The normal solution to a radio frequency pickup of bypassing the radio frequency with a capacitor was not available in the present invention, as the required bypass capacitance was large and would in effect severely degrade the control system's flame sensitivity. An additional impedance 32 was added in series with diode 31 and capacitor 33 that enabled radio frequency bypass capacitor 35 to have a small capacitance value. Series impedance 32 enabled the safety network means 30 of FIG. 4 to be effective against radio frequency interference and false flame flicker signals while still retaining an acceptable level of control system flame flicker sensitivity. It can thus be seen that the radio frequency modification to the safety network means 30 was not readily available or obvious to anyone skilled in the burner control art, but came about after lengthly investigations and has now created a system that is reliable and safe for use in the burner control art.

In one successful embodiment of this invention, the value of the components of the safety network means 30 and the photocell 10 are as follows:

| | | |
|---|---|---|
| Photocell 10 - | dark resistance - | 600,000 ohms to 3 megohms |
| | light resistance - | approximately 100,000 ohms |
| Capacitor 33 | - 47 microfarads | |
| Capacitor 35 | - 0.01 microfarads | |
| Resistor 32 | - 2,000 ohms | |
| Resistor 34 | - 1 megohm | |
| Diode 31 | - Hewlett-Packard 5082-6227 or Motorola MBD502. | |

The numerical values of the successful embodiment described above are of a preferred embodiment, but the inventor wishes to be limited, however, in the scope of the invention solely by the appended claims.

The embodiments of the invention in which an exclusive property or right is claimed are defined as follows:

1. In a fuel burner control system which utilizes flame flicker responsive sensor means to monitor the burning of fuel to thereby control fuel supply means, including; flame flicker responsive sensor means which varies in impedance with exposure to the radiation from a flame wherein said variations in impedance are rapid enough to follow the flicker radiation of said flame; flame flicker responsive amplifier means having input terminals including a voltage source and output terminals with said amplifier means responding to a range of flicker frequency normally found in the variations of radiation from said flame; said flame flicker responsive sensor means connected to said input terminals and fuel flow control means connected to said output terminals; safety network means connected in parallel with said sensor means; and said safety network means including a diode, impedance means, and a first capacitor connected in series circuit and further including a second capacitor and a resistor connected in parallel circuit with each other and in parallel with said diode and said impedance means; said safety network means altering the effect of said sensor means briefly upon the termination of flame to prevent said sensor means from inadvertently sensing a hot refractory surface in said fuel burner by said second capacitor charging from said voltage source at said input terminals.

2. In a fuel burner control system as described in claim 1 wherein said impedance means is a resistor.

3. In a fuel burner control system as described in claim 2 wherein said second capacitor is a low impedance to radio frequencies and a high impedance to flame flicker frequencies.

4. In a fuel burner control system as described in claim 3 wherein said diode is a metal semiconductor diode.

5. In a fuel burner control system as described in claim 4 wherein said diode is a Schottkey barrier diode.

6. In a fuel burner control system as described in claim 5 wherein said flame flicker responsive amplifier means is a band pass type of amplifier with a band-pass range that coincides with the most predominate flicker frequency of a burning fuel being monitored by the control system.

7. In a fuel burner control system as described in claim 6 wherein said fuel flow control means includes a relay to in turn control a fuel valve.

* * * * *